United States Patent [19]

Charbonnel et al.

[11] Patent Number: 4,977,861

[45] Date of Patent: Dec. 18, 1990

[54] SUPERHEATER BUNDLE FOR A HORIZONTAL STEAM SEPARATOR-SUPERHEATER

[75] Inventors: Alain Charbonnel, Vitry; Jean-Claude Foucher, Bagneux, both of France

[73] Assignee: Societe Anonyme dite: Stein Industrie, Velizy-Villacoublay, France

[21] Appl. No.: 450,194

[22] Filed: Dec. 13, 1989

[30] Foreign Application Priority Data

Dec. 15, 1988 [FR] France ..... 88 16557

[51] Int. Cl.[5] ..... F22G 1/00

[52] U.S. Cl. ..... 122/483; 55/269; 122/488; 122/491; 122/510; 165/159

[58] Field of Search ..... 122/483, 488, 491, 510; 55/269, 434; 165/158, 159, 161

[56] References Cited

U.S. PATENT DOCUMENTS 3,326,280 6/1967 Bosquain et al. ..... 165/161
4,382,467 5/1983 Garrison et al. ..... 165/159
4,485,069 11/1984 Byerley ..... 376/405
4,589,893 5/1986 Franzolini et al. ..... 122/483 X
4,671,214 6/1987 Alias et al. ..... 122/483 X
4,714,054 12/1987 Minard et al. ..... 122/483

FOREIGN PATENT DOCUMENTS 1384312 2/1975 United Kingdom .

*Primary Examiner*—Edward G. Favors
*Attorney, Agent, or Firm*—Sughrue, Mion, Zinn, Macpeak & Seas

[57] ABSTRACT

A superheater bundle for a horizontal steam separator-superheater, the bundle comprising an array of parallel tubes disposed in a triangular pitch inside a frame (3, 4) which is polygonal in shape and symmetrical about its plane of symmetry, with the bottom of the frame delimiting an inlet orifice for steam to be superheatd and with the top of the frame delimiting an outlet orifice for superheated steam. At least two of the sloping sides (11, 13, 15, 15, 17; 12, 14, 16, 18) of th polygon-shaped frame (3, 4) are parallel to the sloping segments formed by the pitch of the tubes.

3 Claims, 1 Drawing Sheet

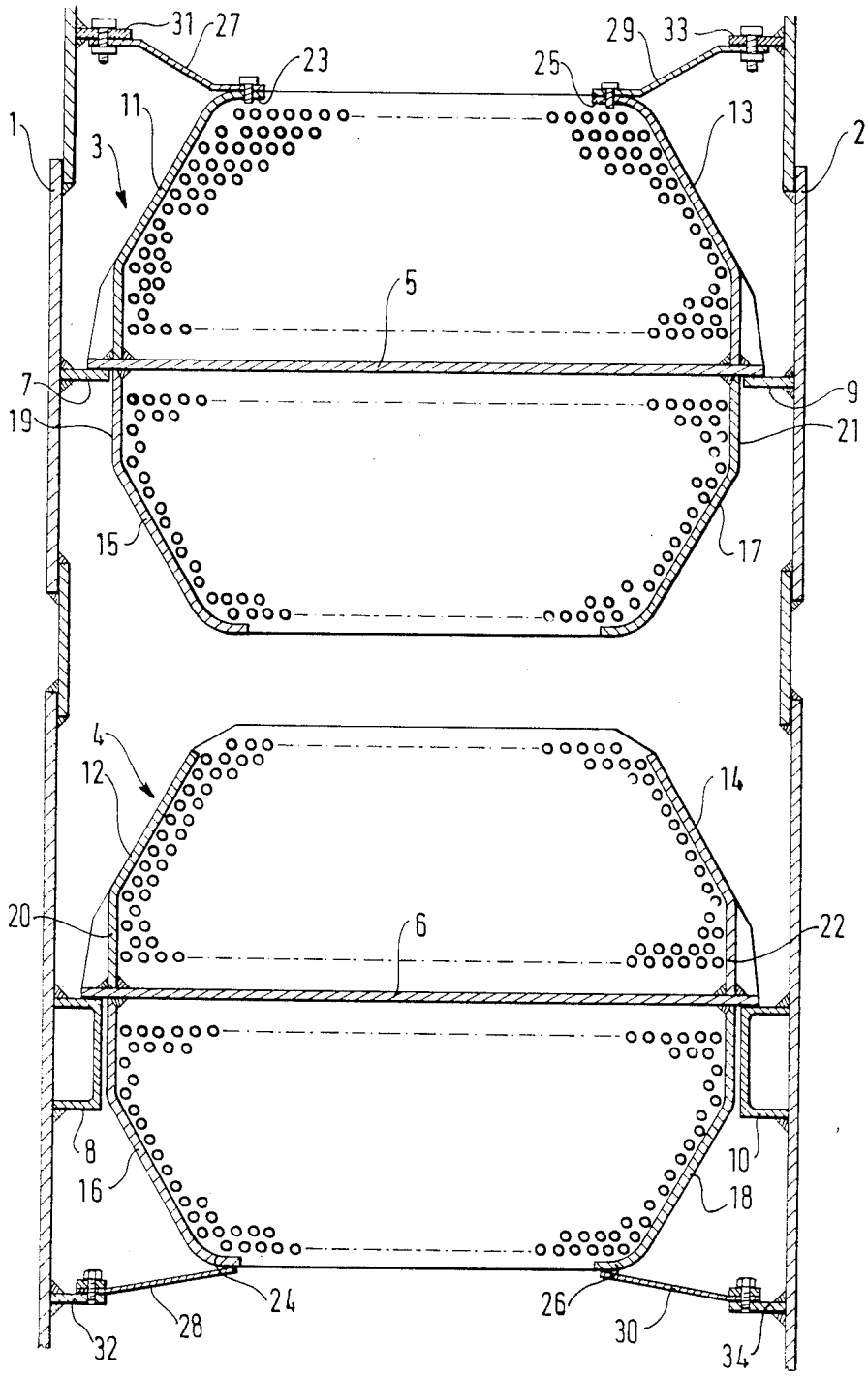
31
27
23
29
33
25
11
13
1
3
2
5
7
9
19
21
15
17
4
12
14
20
6
22
8
10
16
18
24
26
28
30
32
34

SUPERHEATER BUNDLE FOR A HORIZONTAL STEAM SEPARATOR-SUPERHEATER

The present invention relates to a superheater bundle for a horizontal steam separator-superheater, disposed in particular between two stages of an expansion turbine, the bundle comprising an array of parallel tubes disposed in a triangular pitch inside a frame which is polygonal in shape and symmetrical about its plane of symmetry, with the bottom of the frame delimiting an inlet orifice for steam to be superheated and with the top of the frame delimiting an outlet orifice for superheated steam.

BACKGROUND OF THE INVENTION

Patent document U.S. Pat. No. 4,485,069 describes a superheater bundle of this type in which the tubes are disposed inside a cylindrical frame having a circular right cross-section and suspended via dovetail attachments inside an outer frame which is likewise circular and which is connected to the overall structure of the separator-superheater.

In such a bundle, the sloping outermost side rows of tubes in a triangular pitch configuration cannot be occupied in full because the ends of the sloping line segments on which these tubes ought to be located intersect the cylindrical frame and it is not possible to place tubes in the immediate vicinity of the frame. As a result, there are empty spaces round the sides of the bundle, and consequently the steam to be superheated tends to run preferentially therealong because of the lower resistance to steam flow. This gives rise to the steam being heated unevenly, and in addition, the number of tubes in the bundle is not optimum for the cross-sectional area occupied by the bundle.

U.S. Pat. No. 3,326,280 describes a horizontal heat exchanger for reheating and vaporizing a fluid flowing around a bundle of tubes along which there flows a gas which is subjected to cooling and condensation, said tubes being disposed in a rectangular pitch within a frame which is polygonal in shape.

In such a heat exchanger, the number of tubes in the bundle is relatively limited and consequently so is the heat exchange area per unit of cross-section.

The object of the present invention is to provide a superheater bundle for a horizontal steam separator-superheater which fills the right cross-section of its frame uniformly, with the number of tubes per unit right cross-section being optimum, and avoiding any tendency of the steam to be superheated flowing preferentially along the frame.

SUMMARY OF THE INVENTION

In the bundle of the invention at least two of the sloping sides of the polygon-shaped frame are parallel to the sloping segments formed by the pitch of the tubes.

The frame preferably also includes two vertical lateral sides.

The bottom or top sloping sides of the frame are terminated by respective short horizontal segments, and sloping sheets are disposed laterally and rspectively above or beneath the horizontal segments to bear tangentially thereon, so as to prevent any of the steam to be superheated from flowing round the outside of the frame of the bundle of tubes.

BRIEF DESCRIPTION OF THE DRAWING

An embodiment of the invention is described by way of example with reference to the accompanying drawing, in which the sole FIGURE is a right cross-section through a superheater bundle of the invention for a steam separator-superheater.

DETAILED DESCRIPTION

The bundle is contained inside a rectangular frame whose side partitions 1 and 2 are shown, which frame is rigidly connected to the shell of the separator-superheater (not shown).

The superheater tubes are in a hairpin configuration such that each of them passes twice through the plane of the figure which therefore shows top bundle elements 3 and bottom bundle elements 4.

Each of these bundle elements includes a central beam 5 or 6 whose edges rest on lateral supports 7 and 9 and 8 and 10 respectively fixed to the lateral partitions 1 and 2.

The bundle elements are contained within frames 3 and 4 which are in the form of irregular hexagons, comprising sloping sides 11, 13, 15, & 17 and 12, 14, 16 & 18 respectively, and vertical sides 19 and 21 and 20 and 22. These frames delimit bottom and top openings that allow the steam to be superheated to pass through each of the bundle elements. The sloping sides of each frame are parallel to the line segments formed by the triangular pitch tubes such that the end rows of tubes are at a constant distance from the frame, thereby obtaining a maximum packing density of the tubes in the right cross-section of the frames. This also prevents any preferential flow of steam along the frames, which would otherwise give rise to non-uniform superheating.

In order to prevent any preferential flow of the steam to be superheated along the outside surface of the frames 3 and 4, the top sloping sides 11 and 13 of the top frame 3 and the bottom sloping sides 16 and 18 of the bottom frame 4 are extended by short horizontal segments 23 and 25 and 24 and 26 which are tangentially connected to sloping sheets 27 and 29 and 28 and 30 that are bolted to tabs 31 and 33 and 32 and 34 which are welded to the lateral partitions 1 and 2.

The invention is particularly suitable for separator-superheaters for use in power stations and/or steam generators for multistage steam expansion turbines.

We claim:

1. A superheater bundle for a horizontal steam separator-superheater including a vertically upright steam tight frame comprising laterally opposed side partitions, said bundle comprising a pair of upper and lower irregular polygonal, steam tight tube array frames each comprising laterally opposed vertical sides integrally connected to respective laterally facing, oppositely sloping sides which converge towards each other and are spaced apart from each other, and said sloping sides having ends remote from said vertical sides defining at least a bottom steam inlet orifice for said lower steam tight tube array frame and a top steam outlet orifice for said upper steam tight tube array frame, said steam tight tube array frames being polygonal in shape and symmetrical about a common vertical plane of symmetry, an array of parallel tubes disposed in a triangular pitch inside each said steam tight tube array frame with at least two of the sloping sides of the polygon-shaped frames being parallel to sloping tube array segments formed by the pitch of the tubes whereby the superheater bundle fills the right cross section of said pair of steam tight tube array frames uniformly with the number of tubes per unit right cross section being optimum while avoiding any tendency of the steam to be superheated to flow preferentially along the exterior of said irregular polygon steam tight tube array frames.

2. A bundle according to claim 1, wherein each of said pair of upper and lower irregular polygonal steam tight, tube array frames has two laterally spaced vertical sides integral with laterally facing, oppositely sloping, sides defining bottom steam inlet orifice and top steam outlet orifice respectively for each of said upper and lower steam tight irregular polygonal, steam tight, tube array frames.

3. A bundle according to claim 1, wherein the sloping sides of the pair of upper and lower oppositely facing irregular polygon steam tight tube array frames are terminated at said ends remote from said vertical sides by integral, short length horizontal segments which project towards each other, and which define an inlet orifice and the outlet orifice respectively for each tube array frame and wherein said bundle further comprises sloping sheets disposed laterally of and respectively above and beneath the short length horizontal segments of said upper and lower steam tight tube array frames, bear tangentially thereon, and extend between said laterally opposed side partitions and said respective short length horizontal segments so as to prevent of the steam to be superheated from flowing around the outside of the pair of upper and lower irregular polygonal steam tight, tube array frames.

* * * * *